US006550691B2

(12) United States Patent
Pence

(10) Patent No.: US 6,550,691 B2
(45) Date of Patent: Apr. 22, 2003

(54) REAGENT DISPENSER HEAD

(76) Inventor: Steve Pence, 309 Laurelwood Rd., #17, Santa Clara, CA (US) 95054

( * ) Notice: Subject to any disclaimer, the term of this patent is extended or adjusted under 35 U.S.C. 154(b) by 56 days.

(21) Appl. No.: 09/861,617

(22) Filed: May 22, 2001

(65) Prior Publication Data

US 2002/0175220 A1 Nov. 28, 2002

(51) Int. Cl.[7] ..... B05B 1/08

(52) U.S. Cl. ..... 239/102.2; 239/101; 239/548; 239/552; 239/557

(58) Field of Search ..... 239/101, 102.1, 239/102.2, 548, 552, 556, 557, DIG. 19; 128/200.14, 200.16

(56) References Cited

U.S. PATENT DOCUMENTS

| | | | | |
|---|---|---|---|---|
| 3,683,212 A | | 8/1972 | Zoltan | |
| 4,530,464 A | | 7/1985 | Yamamoto et al. | |
| 4,533,082 A | | 8/1985 | Maehara et al. | |
| 4,605,167 A | | 8/1986 | Maehara | |
| 4,700,203 A | | 10/1987 | Yamamuro et al. | |
| 4,702,418 A | * | 10/1987 | Carter et al. | 239/102.2 |
| 4,877,745 A | | 10/1989 | Hayes et al. | |
| 5,483,469 A | | 1/1996 | Van den Engh et al. | |
| 5,487,378 A | * | 1/1996 | Robertson et al. | 128/200.14 |
| 5,518,179 A | | 5/1996 | Humberstone et al. | |
| 5,586,723 A | * | 12/1996 | Chen et al. | 239/102.2 |
| 5,838,350 A | | 11/1998 | Newcombe et al. | |
| 5,854,645 A | | 12/1998 | Witteveen et al. | |
| 5,938,117 A | * | 8/1999 | Ivri | 239/102.2 |
| 5,971,528 A | | 10/1999 | Yoshimura | |
| 6,001,309 A | | 12/1999 | Gamble et al. | |
| 6,063,339 A | | 5/2000 | Tisone et al. | |

* cited by examiner

*Primary Examiner*—Steven J. Ganey
(74) *Attorney, Agent, or Firm*—Richard C. Litman

(57) ABSTRACT

The reagent dispenser head has a piezoelectric actuator supported by a back plate, a front plate having a conical well and a fluid inlet connected by a shallow channel, and a thin, impermeable membrane disposed between the piezoelectric actuator and the well. The well has a window defined therein opening on a nozzle plate having an array of orifices which are arranged to define a predetermined image or pattern. The dispenser head is supplied with a reagent or other liquid through the fluid inlet, the fluid feeding into the well through the channel. A control system is connected to the piezoelectric actuator to provide an electrical pulse or trigger which causes the piezoelectric actuator to bend or deform, contracting the depth of the well and ejecting drops of reagent through all the orifices simultaneously, coating a substrate with reagent in the image pattern.

16 Claims, 6 Drawing Sheets

REAGENT DISPENSER HEAD

BACKGROUND OF THE INVENTION

1. Field of the Invention

The present invention relates to a reagent dispenser head, and particularly to a dispenser head with a piezoelectric actuator which dispenses reagents and other chemical solutions through a nozzle plate in droplets.

2. Description of the Related Art

It is frequently desirable to coat a surface or membrane with drops of a chemical or reagent material forming an image or pattern. Typical applications for this technology include test strips used for medical diagnostics, microarrays, "lab on a chip", etc. Current technology uses dispensing systems having one hundred twenty-eight or more separate droplet actuators arranged in the desired image pattern and/or devices with motion control systems to move single droplet actuators in the desired image pattern. The problem with such devices is that the separate actuator systems render it difficult to achieve uniformity in droplet size, and while many advances have been achieved in motion control systems, it is often difficult to achieve both accuracy and precision in replicating images faithfully. In addition, these systems tend to be complex and expensive due to the duplication of components and the cost and expense of electronic control systems. The present invention overcomes the difficulties of prior art systems through a reagent dispensing head having a piezoelectric actuator (preferably a bimorph), a single nozzle plate having a plurality of orifices defining an image pattern, and a capillary fluid feed system disposed between the piezoelectric actuator and the nozzle plate. A control system generates a single pulse for actuating the piezoelectric element.

Known devices for dispensing fluid droplets using a single piezoelectric actuator, a single fluid chamber, and a single orifice or nozzle for each droplet include U.S. Pat. No. 3,683,212, issued Aug. 8, 1972 to S. I. Zoltan (tubular ceramic piezoelectric transducer expanding and contracting radially to eject fluid quantity proportional to voltage rise time); U.S. Pat. No. 4,877,745, issued Oct. 31, 1989 to Hayes et al. (plurality of jet heads for dispensing reagents into cells or printing test strips or ink onto paper, each jet head having a separate tubular piezoelectric transducer and a separate orifice); and U.S. Pat. No. 5,483,469, issued Jan. 9, 1996 to Van den Engh et al. (cytometer having a fluid flow chamber with a single orifice and a piezoelectric crystal for creating a single steady flow of drops).

Several inkjet printing devices are of this variety, representative patents including U.S. Pat. No. 5,854,645, issued Dec. 29, 1998 to Witteveen et al. (inkjet area with plurality of ink chambers); U.S. Pat. No. 5,971,528, issued Oct. 26, 1999 to M. Yoshimura (plurality of ink jet channels formed by piezoelectric walls); and U.S. Pat. No. 4,700,203, issued Oct. 13, 1987 to Yamamura et al. (ink jet head including some embodiments having a bimorh actuator).

Several devices for delivering measured or metered doses of medications or other fluids use piezoelectric transducers, often vibrating at the crystal's resonant frequency. Representative examples include U.S. Pat. No. 5,487,378, issued Jan. 1, 1996 to Robertson et al. (inhaler with a conically shaped port with a nozzle having a plurality of holes and a piezoelectric disc vibrating at the resonant frequency); U.S. Pat. No. 5,518,179, issued May 21, 1996 (atomizer with membrane having multiple perforations and piezoelectric transducer attached directly to membrane); U.S. Pat. No. 5,838,350, issued Nov. 17, 1998 to Newcombe et al. (cylindrical transducer and perforated membrane which vibrates); German Patent No. 2,915,851, published Oct. 30, 1980 (cylindrical piezoelectric transducer with jet formed by glass capillary tube and having circuitry for ejecting measured quantity of fluids); and U.K. Patent No. 2,240,494, published Aug. 7, 1991 (atomizer with membrane having plurality of holes and piezoelectric transducer indirectly connected to the membrane in order to vibrate the membrane).

Other relevant devices are described in U.S. Pat. No. 6,001,309, issued Dec. 14, 1999 to Gamble et al. (device for creating an array of microspots for laboratory screening and assays which has a plurality of jet devices moved as a group); U.S. Pat. No. 6,063,339, issued May 16, 2000 to Tisone et al. (device for precisely dispensing dots of reagents onto test strips, test arrays, well plates, etc., including a dispensing head, a pump device and a controller for moving the dispensing head and/or table in the X, X–Y, or X–Y–Z directions); U.S. Pat. No. 4,530,464, issued to Yamamoto et al on Jul. 23, 1985 (annular piezoelectric transducer with nozzle plate having a plurality of holes fixedly attached to the transducer); and U.S. Pat. Nos. 4,533,082 and 4,605,167 issued to Maehara et al. and N. Maehara on Aug. 6, 1985 and Aug. 12, 1986, respectively (ring-shaped piezoelectric transducer with nozzle plate having one or more holes therein bonded to transducer and vibrating at resonant frequency).

None of the above inventions and patents, taken either singularly or in combination, is seen to describe the instant invention as claimed. Thus a reagent dispenser head solving the aforementioned problems is desired.

SUMMARY OF THE INVENTION

The reagent dispenser head has a piezoelectric actuator supported by a back plate, a front plate having a conical well and a fluid inlet connected by a shallow channel, and a thin, impermeable membrane disposed between the piezoelectric actuator and the spherical well. The well has a window defined therein opening on a nozzle plate having an array of orifices which are arranged to define a predetermined image or pattern. The dispenser head is supplied with a reagent or other liquid through the fluid inlet, the fluid feeding into the well through the channel. A control system is connected to the piezoelectric actuator to provide an electrical pulse or trigger which causes the piezoelectric actuator to bend or deform, contracting the depth of the well and ejecting drops of reagent through all the orifices simultaneously, coating a substrate with reagent in the image pattern.

The reagent dispenser head is most useful in laboratory applications, such as medical diagnostics, microarrays, lab on a chip, etc. The reagent dispenser head may be used in the preparation of indicator strips. The reagent dispenser head eliminates the need for multiple dispensing heads and motion control systems to dispense droplets in a pattern by means of the single nozzle plate with multiple orifices in the desired pattern, resulting in significant cost reduction. The use of a single piezoelectric actuator and control signal helps to ensure that the image pattern may be reproduced with precision and accuracy.

Accordingly, it is a principal object of the invention to provide a reagent dispenser head which dispenses multiple drops of a reagent simultaneously in a predetermined image pattern.

It is another object of the invention to dispense multiple drops of reagent in a predetermined image pattern with a single control signal in order to improve reproducibility of the image by eliminating irregularities in timing of multiple control signals.

It is a further object of the invention to dispense multiple drops of reagent in a predetermined image pattern without the necessity of a motion control system for movement of the dispensers head, thereby avoiding irregularities produced by variations in mechanical tolerances and mechanical degradation of the motion control system.

Still another object of the invention is to provide a reagent dispenser head for dispensing multiple drops of reagent in a predetermined image pattern with few moving parts.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
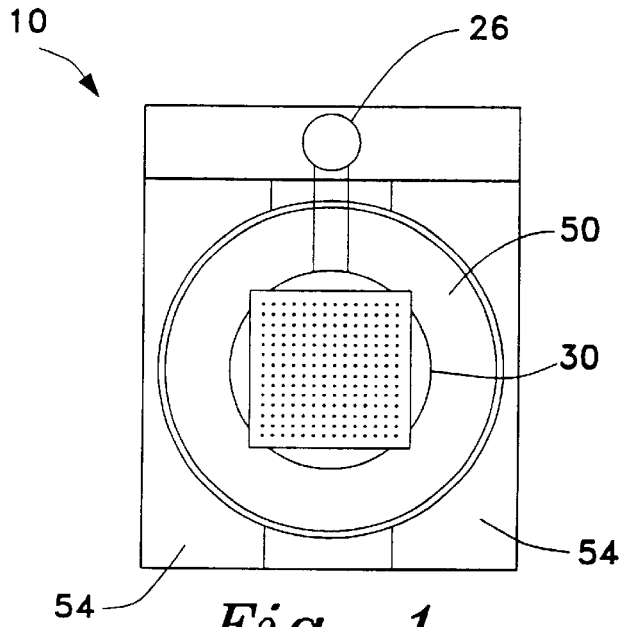
FIG. 1 is a front elevation view of a reagent dispenser head according to the present invention.

The present invention is a reagent dispensing head, designated generally as 10 in the drawings, for dispensing drops of reagent in an image pattern for applications in medical diagnostics, microarrays, test papers or indicator strips, "lab on a chip", and other laboratory applications. The reagent dispensing head 10 of the present invention is distinctive for dispensing multiple drops of a reagent of other fluid or liquid simultaneously in a predetermined pattern for coating a substrate.

Figure 2:
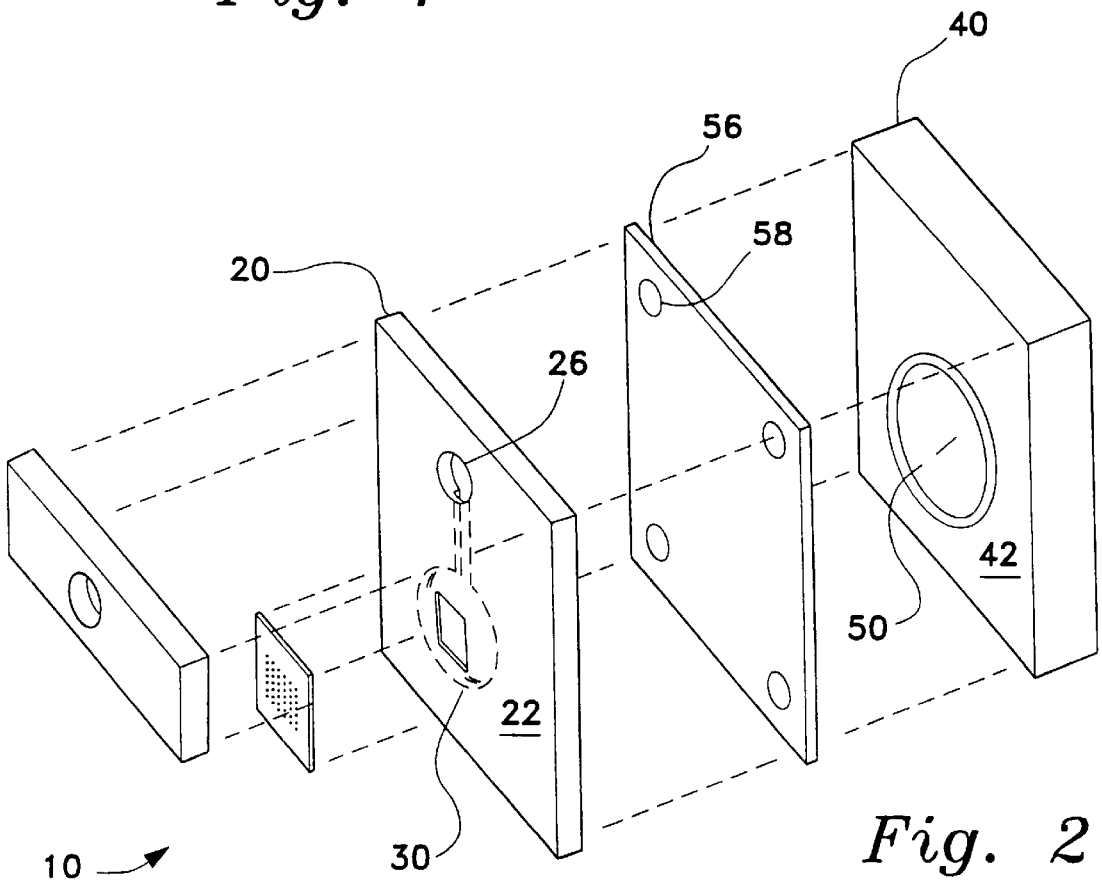
FIG. 2 is an exploded view of a reagent dispenser head according to the present invention.
Figure 3:
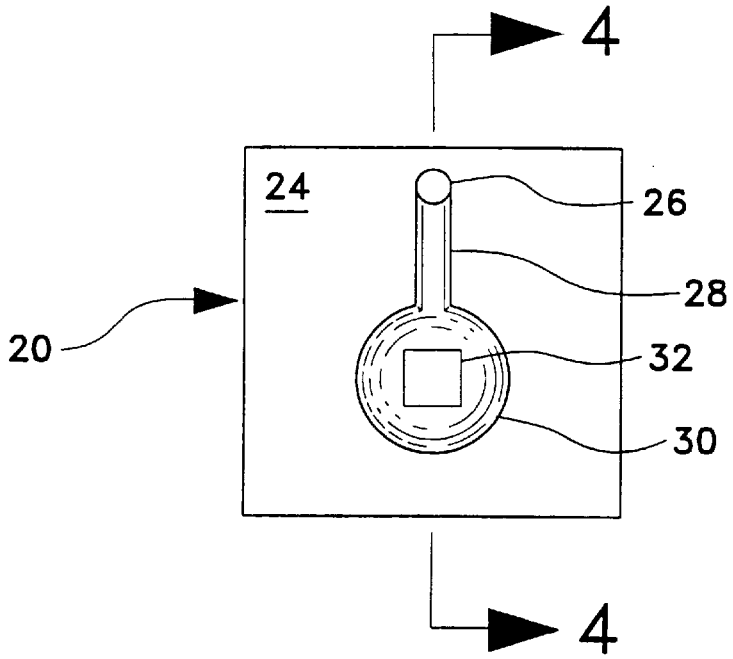
FIG. 3 is a rear view of the front plate of a reagent dispenser head according to the present invention.
Figure 4:
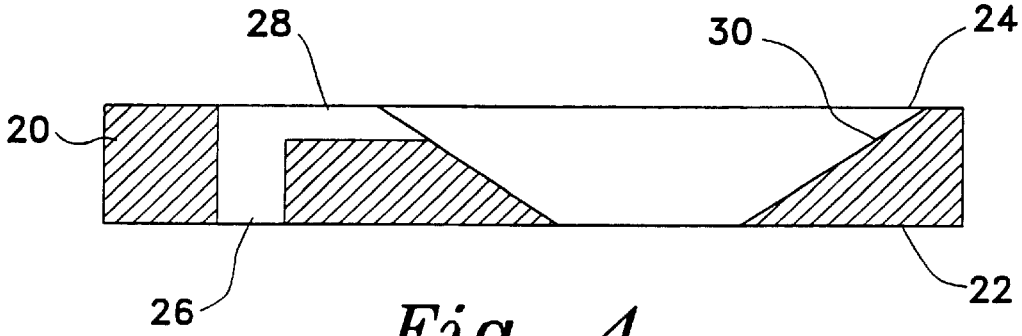
FIG. 4 is a section view along the lines 4—4 of FIG. 3.

As shown in FIGS. 1–5, the reagent dispensing head 10 has a housing including a front plate 20 and a back plate 40 which are permanently bonded together. As seen in FIGS. 2–4, the front plate 20 has a front face 22 and a rear face 24. A cylindrical fluid inlet 26 is defined through the front plate 20. A shallow fluid channel 28 extends radially from one side of the fluid inlet 26. The opposite end of the fluid channel 28 is shown terminating in a conical well 30, i.e., a well having a conical shape, although a spherical well having the shape of a spherical section may also be used. The base of the well 30, i.e., the front face 22 of the front plate 20, has a window 32 defined therein. The window 32 is shown having a rectangular shape, although other shapes, e.g., circular, are within the scope of the present invention.

Figure 5:
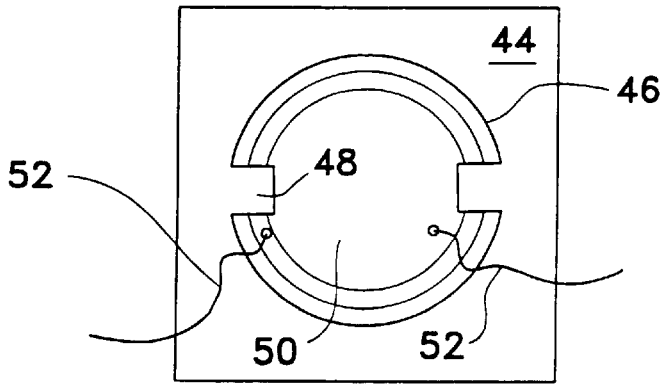
FIG. 5 is a rear view of the back plate of a reagent dispenser head according to the present invention with the terminal plates removed.

As shown in FIGS. 2 and 5, the rear plate 40 has a front face 42, a rear face 44, and a cylindrical opening 46 defined therein. A pair of diametrically opposed mounting tabs 48 protrude radially inward into the cylindrical opening 46. The tabs are flush with the rear face 44, but are not as thick as the rear plate 40, so that the tabs 48 are recessed from the front face 42. A piezoelectric actuator 50 is mounted in the cylindrical opening 46 and secured to the mounting tabs 48. A pair of wire leads 52 are secured to the piezoelectric contact surfaces, as by soldering, and are attached to thin, copper terminal plates 54 which are affixed to the rear face 44 of the rear plate 40.

A thin, flexible, impermeable membrane 56 is disposed between the piezoelectric actuator 50 and the well 30, and may be affixed to the piezoelectric actuator 50 by double-sided adhesive tape, in order to prevent fluid from leaking from the well 30 into the cylindrical opening 46 and coming into contact with the piezoelectric actuator 50 and shorting the wire leads 52. The membrane 56 may have a plurality of holes 58 defined therein outside of the radius of the well 30 in order to increase the flexibility of the membrane 56. The membrane 56 may be made from transparent Mylar® or other liquid impermeable polymer which is also impervious to the reagent to be dispensed.

A narrow reinforcement band 60 may be overlaid on the top portion of the front face 22 of the front plate. The reinforcement band 60 serves to increase the depth of the fluid inlet 26 to help retain a delivery tube, fitting, or other fluid conduit delivering reagent from a reservoir to the reagent head 10, and to create a pressure head at the fluid inlet 26. The front plate 20, the back plate 40, and the reinforcing band 60 are preferably made from a transparent polymer, such as polymethyl methacrylate (PMMA), although these components can be made from injection molded polycarbonate.

Figure 6:
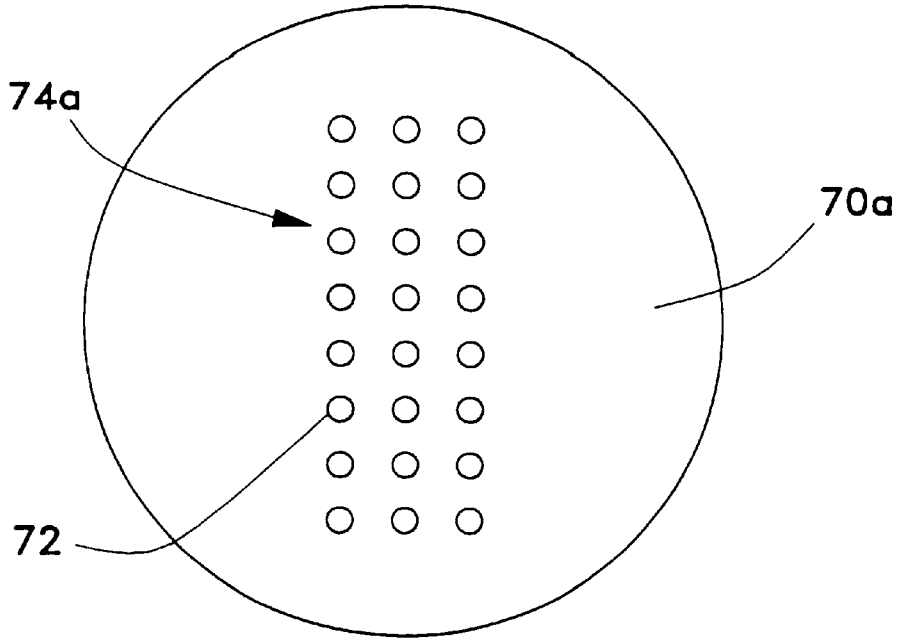
FIG. 6 is a front view of a nozzle plate according to the present invention.
Figure 7:
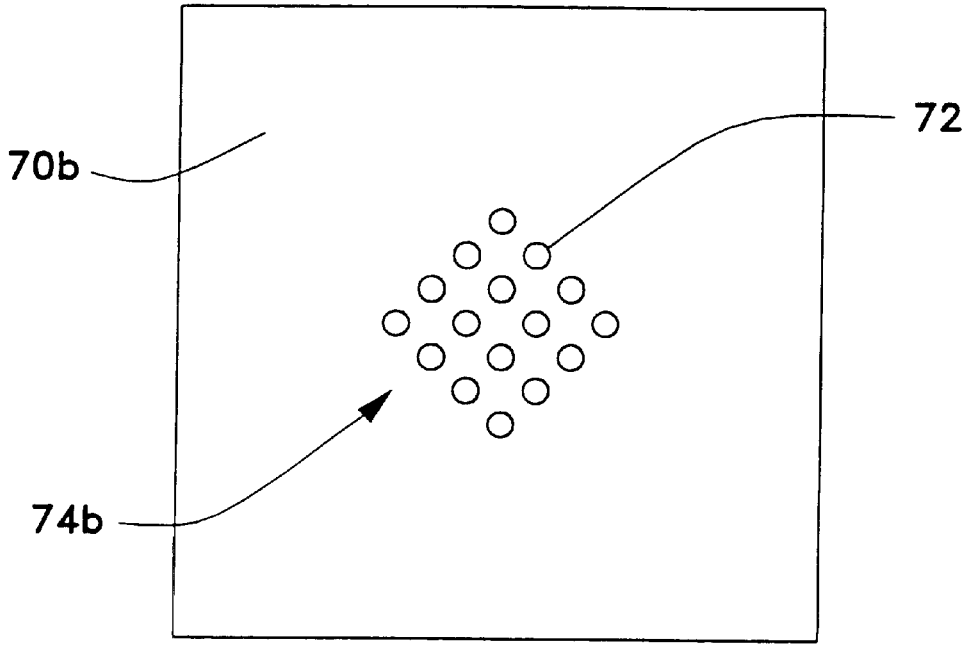
FIG. 7 is a front view of an alternative embodiment of a nozzle plate according to the present invention.

A nozzle plate 70 is attached to the front plate 20 to cover the window 32. The nozzle plate 70 has a plurality of orifices 72 defined therein. As shown in FIG. 6, the nozzle plate 70*a* may be circular or disk shaped. Alternatively, the nozzle plate 70*b* may be square as shown in FIG. 7. Although the reagent dispensing head 10 is shown as rectangular in the drawings, the shape of the reagent dispensing head 10 is not critical, provided that the dispensing head 10 includes a nozzle plate 70, a piezoelectric actuator 50 disposed parallel to and spaced apart from the nozzle plate 70, and well 30 disposed between the nozzle plate 20 and piezoelectric actuator 50, which together define a fluid chamber.

As shown in FIGS. 6 and 7, the plurality of orifices 72 define an image or pattern with which it is desired to coat a substrate.

The image 74*a* may be linear, as shown in FIG. 6, a diamond-shaped image 74*b*, as shown in FIG. 7, circular, rectangular, or any other desired image pattern. The nozzle plate 70 may be made of metal, such as a nickel alloy, or it may be a thin plastic membrane made from a thermoplastic substance, such as Mylar® (a product of E.I. duPont de Nemours & Co.), which is impervious and inert with respect to the reagent. As many has one hundred twenty-eight orifices 72 may be defined in the nozzle plate 70 with great precision by boring the holes through the nozzle plate 70 with a laser. Alternatively, the nozzle plate 70 may be a silicon wet etched nozzle plate. The orifices 72 may be cylindrical, having a uniform diameter through the entire thickness of the nozzle plate 70, or the orifices 72 may be conical.

The reagent dispensing head 10 is supplied with reagent from a reservoir by a fluid conduit connected to the fluid inlet 26, and is transported to the well 30 through flow channel 28 by being drawn by capillary action. At equilibrium the diameter of the orifices 72 is small enough that surface tension retains the reagent in the well 30 without leakage through the orifices 72 at atmospheric pressure.

The piezoelectric actuator 50 is planar, and preferably a bimorph actuator, although any type of piezoelectric may be used, the bimorph type not being critical to the invention. A bimorph consists of two thin sheets of piezoelectric material bonded together or bonded to opposite sides of a thin metal strip. When voltages of opposite polarity are applied to the thin sheets of piezoelectric material, the piezoelectric deforms, one side contracting and the other side expanding, the two forces coacting to produce bending of the bimorph. Deformation of the shape of the piezoelectric actuator 50 by an applied voltage results in a change in the volume of the well 30, with contraction of the volume of the well 30 causing simultaneous ejection of drops of reagent through all of the orifices 72 in the nozzle plate 70, resulting in the coating of the substrate with reagent in the image pattern defined in the nozzle plate 70.

Figure 8:
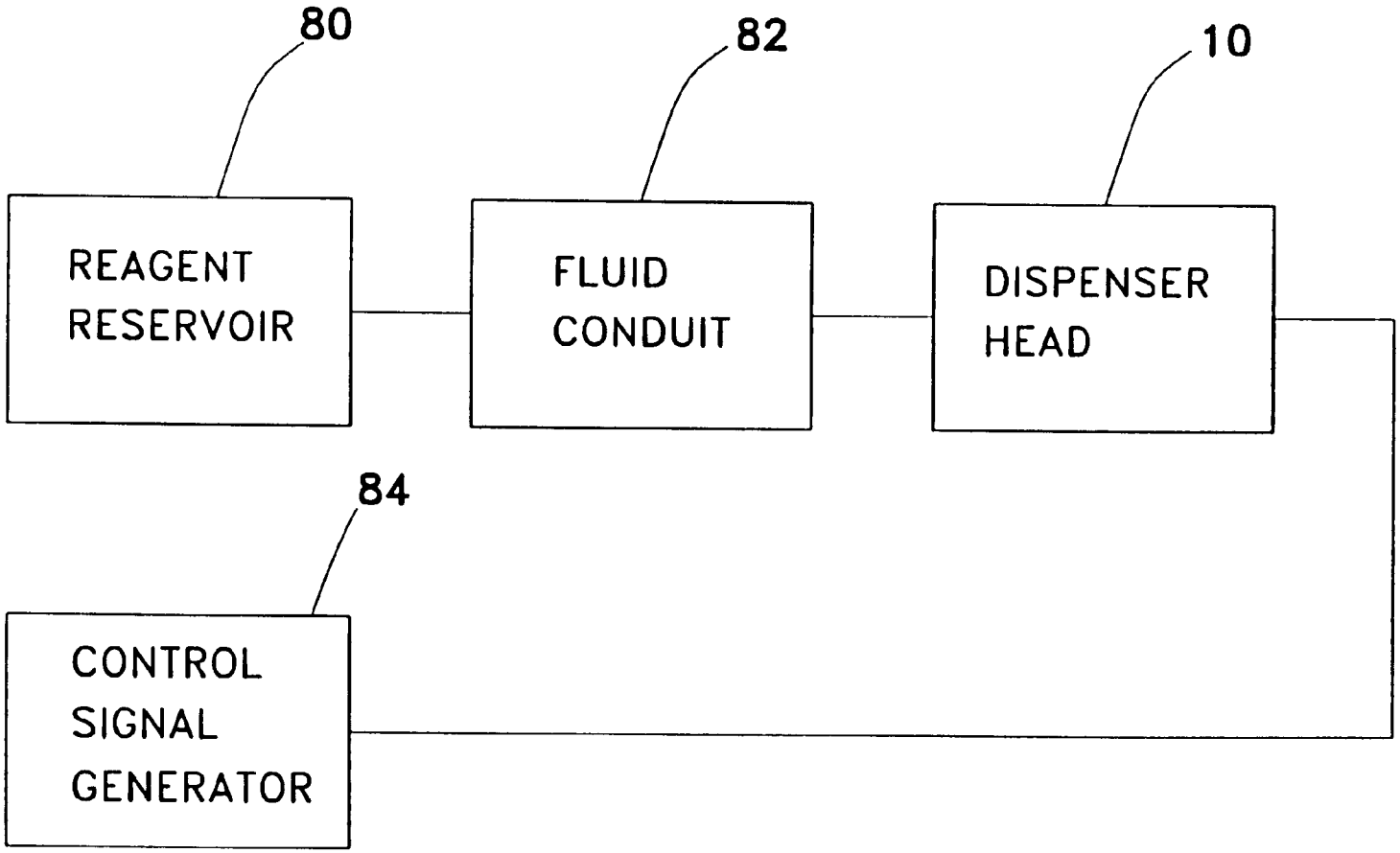
FIG. 8 is a block diagram of a reagent dispensing system according to the present invention.

FIG. 8 depicts a block diagram of the components of a reagent dispensing system. A supply of reagent is maintained in a reservoir 80 and is drawn into the reagent dispenser head 10 through the fluid conduit 82 by the capillary feed system. At equilibrium, reagent is retained in the dispenser head 10 by surface tension. When it is desired to dispense reagent onto the substrate, a control signal generator 84 produces at least one trigger pulse to the piezoelectric actuator 50 through terminals 54. It will be understood that although terminals 54 have been described as flat copper sheets, terminals 54 may comprise any form of electrical contacts known in the art.

Figure 9A:
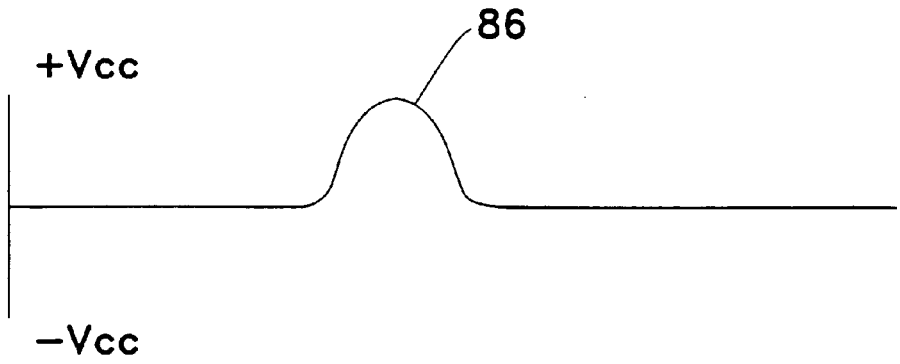
FIGS. 9A, 9B and 9C are diagrams of control signals which may be used to actuate a reagent dispensing head according to the present invention.
Figure 9B:
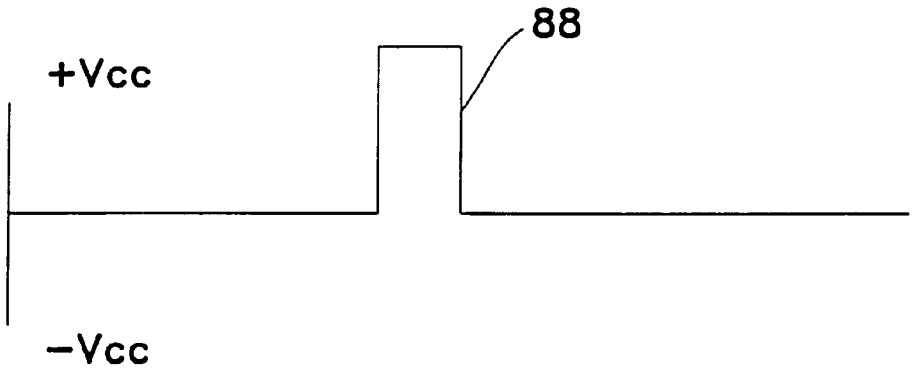
Figure 9C:
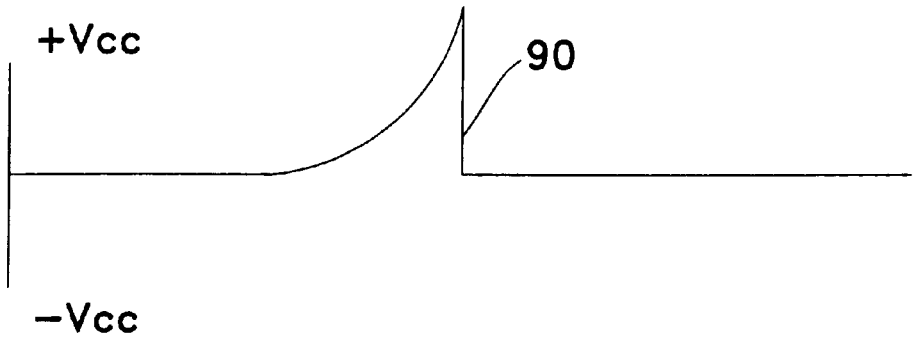

As shown in FIGS. 9A, 9B, and 9C, the trigger pulse may be a sine wave 86, a square wave 88, a sawtooth wave 90, or a complex series of pulses, respectively. Each pulse if approximately 100 $\mu$s in width and an amplitude between about 60 and 100 volts. It will be understood that although each pulse is shown as a positive pulse, a negative voltage pulse may be used, depending on the circuit configuration. The polarity of the pulse can also be used to change the direction of deformation of the piezoelectric actuator, expanding the volume of the well in one direction, and contracting the volume in the opposite direction. A variety of circuits are conventionally known in the art for producing the trigger pulse, such as a 555 timer integrated circuit configured as a monostable multivibrator with either a switch to trigger the pulse, or an RC circuit to time the pulse, and therefore the control signal generator 84 will not be described in detail.

Figure 10:
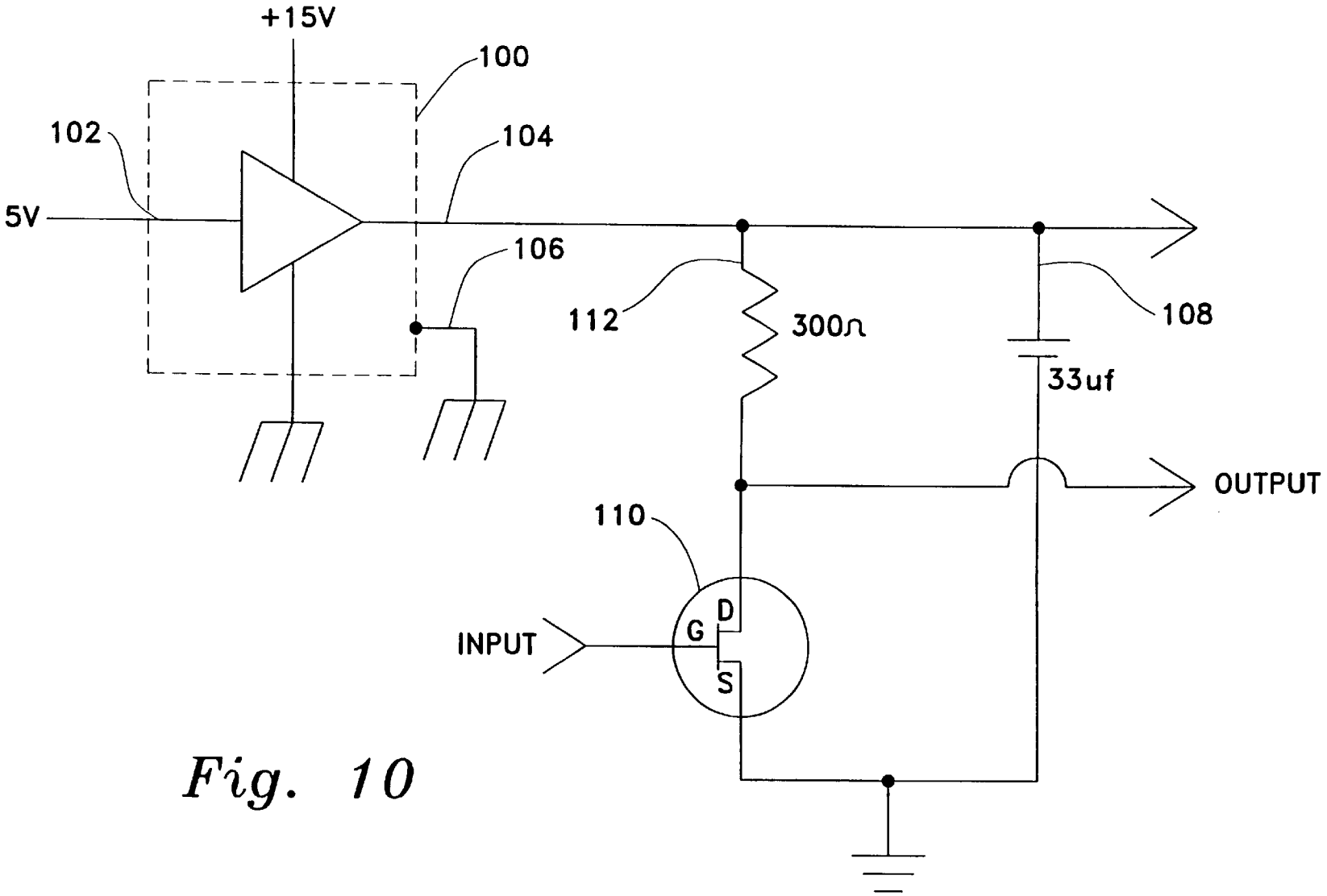
FIG. 10 is a partial schematic of a control signal generator for a reagent dispensing head according to the present invention.

A portion of the circuit used to amplify the trigger pulse to the voltage necessary to trigger the piezoelectric actuator is, however, shown in FIG. 10. The circuit employs a miniature high voltage DC converter 100, shown schematically as equivalent to an amplifier, such as an EMCO C Series high voltage power supply, manufactured by EMCO High Voltage Corp. of Sutter Creek, Calif. The DC converter 100 operates on a 15 V DC supply and produces an output voltage between 0 and 100 V given an input between 0–5 V. In this application, a 5 V DC voltage is applied to the input pin 102 to produce 100 V at the output pin 104. The case is grounded at 106 for safety. A capacitor 108 is applied across the output pin to smooth any ripple in the output voltage. The trigger pulse is applied to the gate of a field effect transistors (FET) 110. The output trigger pulse is developed across a load resistor 112 connected to the drain of the FET 110.

It will be noted that the control signal is a one shot pulse and not an oscillating waveform, as it is not desired to produce a continuous spray, but a single layer of drops on demand. If a second coating is desired, a second control signal may be generated.

It will be obvious to those skilled in the art that the reagent dispenser head 10 of the present invention may be used in an automated production line by mounting the dispenser head 10 on a carrier for moving the dispenser head 10 from one substrate to the next, or by maintaining the dispenser head 10 stationary on a fixed mount while moving substrates on a conveyer belt under the dispenser head 10.

It is to be understood that the present invention is not limited to the embodiments described above, but encompasses any and all embodiments within the scope of the following claims.

I claim:

1. A reagent dispenser head for coating a substrate with multiple drops of reagent simultaneously, comprising:

(a) a nozzle plate having a plurality of orifices defining an image pattern;

(b) a planar piezoelectric actuator adapted for attachment to a control signal generator; and (c) a housing maintaining said nozzle plate and said piezoelectric actuator in parallel and spaced apart relation, said nozzle plate, said piezoelectric actuator, and said housing defining a fluid chamber, said housing having:

(i) a back plate having an opening defined therein, said piezoelectric actuator being mounted in said opening;

(ii) a front plate having a fluid inlet defined therethrough and having a front surface and a back surface;

(iii) a conical well defined in the back surface of said front plate, the conical well having a window opening defined through the front surface of said front plate, said nozzle plate being disposed to cover said window opening;

(iv) a shallow capillary flow channel defined in the back surface extending between the fluid inlet and said conical well; and (v) a thin, flexible, impermeable membrane disposed between said piezoelectric actuator and the well defined in the back surface of said front plate in order to prevent reagent in the well from direct contact with said piezoelectric actuator; wherein (d) said piezoelectric actuator is deformable upon receiving a trigger signal from the control signal generator so that the volume of said fluid chamber is reduced in order to coat the substrate with multiple drops of the reagent simultaneously in the image pattern defined by said nozzle plate.

2. The reagent dispenser head according to claim 1, wherein said nozzle plate is made from metal.

3. The reagent dispenser head according to claim 1, wherein said nozzle plate comprises a thin membrane made from silicon.

4. The reagent dispenser head according to claim 1, wherein said piezoelectric actuator is a bimorph.

5. The reagent dispenser head according to claim 1, wherein said nozzle plate is circular.

6. The reagent dispenser head according to claim 1, wherein said nozzle plate is rectangular.

7. The reagent dispenser head according to claim 1, wherein said fluid chamber comprises a capillary channel, reagent being drawn into said fluid chamber by capillary action.

8. The reagent dispenser head according to claim 1, further comprising a control signal generator electrically connected to said piezoelectric actuator.

9. A reagent dispenser head for coating a substrate with multiple drops of reagent simultaneously, comprising:

(a) a nozzle plate having a plurality of orifices defining an image pattern;

(b) a planar piezoelectric actuator;

(c) a housing maintaining said nozzle plate and said piezoelectric actuator in parallel and spaced apart relation, said nozzle plate, said piezoelectric actuator, and said housing defining a fluid chamber, said housing having:

(i) a back plate having an opening defined therein, said piezoelectric actuator being mounted in said opening;

(ii) a front plate having a fluid inlet defined therethrough and having a front surface and a back surface;

(iii) a conical well defined in the back surface of said front plate, the conical well having a window opening defined through the front surface of said front plate, said nozzle plate being disposed to cover said window opening;

(iv) a shallow capillary flow channel defined in the back surface extending between the fluid inlet and said conical well; and (v) a thin, flexible, impermeable membrane disposed between said piezoelectric actuator and the well defined in the back surface of said front plate in order to prevent reagent in the well from direct contact with said piezoelectric actuator; and (d) a control signal generator electrically connected to said piezoelectric actuator; and wherein (e) said piezoelectric actuator is deformable upon receiving a trigger signal from said control signal generator so that the volume of said fluid chamber is reduced in order to coat the substrate with multiple drops of the reagent simultaneously in the image pattern defined by said nozzle plate.

10. The reagent dispenser head according to claim 9, wherein said control signal generator is capable of generating a voltage pulse upon demand for deforming said piezoelectric actuator to contract the volume of said fluid chamber.

11. The reagent dispenser head according to claim 10, wherein said voltage pulse is a sine wave.

12. The reagent dispenser head according to claim 10, wherein said voltage pulse is a square wave.

13. The reagent dispenser head according to claim 10, wherein said voltage pulse is a sawtooth wave.

14. The reagent dispenser head according to claim 9, wherein said fluid chamber comprises a capillary channel, reagent being drawn into said fluid chamber by capillary action.

15. The reagent dispenser head according to claim 9, wherein said nozzle plate is made from metal.

16. The reagent dispenser head according to claim 9, wherein said nozzle plate comprises a thin membrane made from silicon.

* * * * *